US006467646B2

(12) United States Patent
Schäfer

(10) Patent No.: US 6,467,646 B2
(45) Date of Patent: Oct. 22, 2002

(54) BOX-SHAPED CONTAINER OF SYNTHETIC RESIN MATERIAL

(75) Inventor: Gerhard Schäfer, Neunkirchen (DE)

(73) Assignee: Fritz Schafer GmbH, Neunkirchen (DE)

( * ) Notice: Subject to any disclaimer, the term of this patent is extended or adjusted under 35 U.S.C. 154(b) by 1 day.

(21) Appl. No.: 09/834,311

(22) Filed: Apr. 12, 2001

(65) Prior Publication Data

US 2002/0030057 A1 Mar. 14, 2002

(30) Foreign Application Priority Data

Apr. 12, 2000 (DE) ..... 200 06 767 U
Dec. 8, 2000 (EP) ..... 00126920 U

(51) Int. Cl.[7] ..... B65D 1/38
(52) U.S. Cl. ..... 220/600; 220/1.5; 220/605; 220/636

(58) Field of Search ..... 220/600, 1.5, 623, 220/628, 636, 729, 605, 609

(56) References Cited

U.S. PATENT DOCUMENTS 3,812,995 A * 5/1974 Lewis ..... 220/605 X
4,484,168 A * 11/1984 Crow ..... 220/628 X
4,742,933 A * 5/1988 Panick ..... 220/628
5,332,115 A * 7/1994 Schafer ..... 220/636 X
5,735,431 A * 4/1998 LeTrudet ..... 220/636 X

* cited by examiner

*Primary Examiner*—Steven Pollard
(74) *Attorney, Agent, or Firm*—Herbert Dubno

(57) ABSTRACT

A box shaped container having reinforcing ribs on its bottom has strips or a bottom plate formed unitarily with the container during the injection molding thereof and swingable about a film hinge on other ligature over the ribbed structure where it can be secured in place, thereby providing a riding rim and reinforcing the bottom.

17 Claims, 8 Drawing Sheets

Fig. 8A
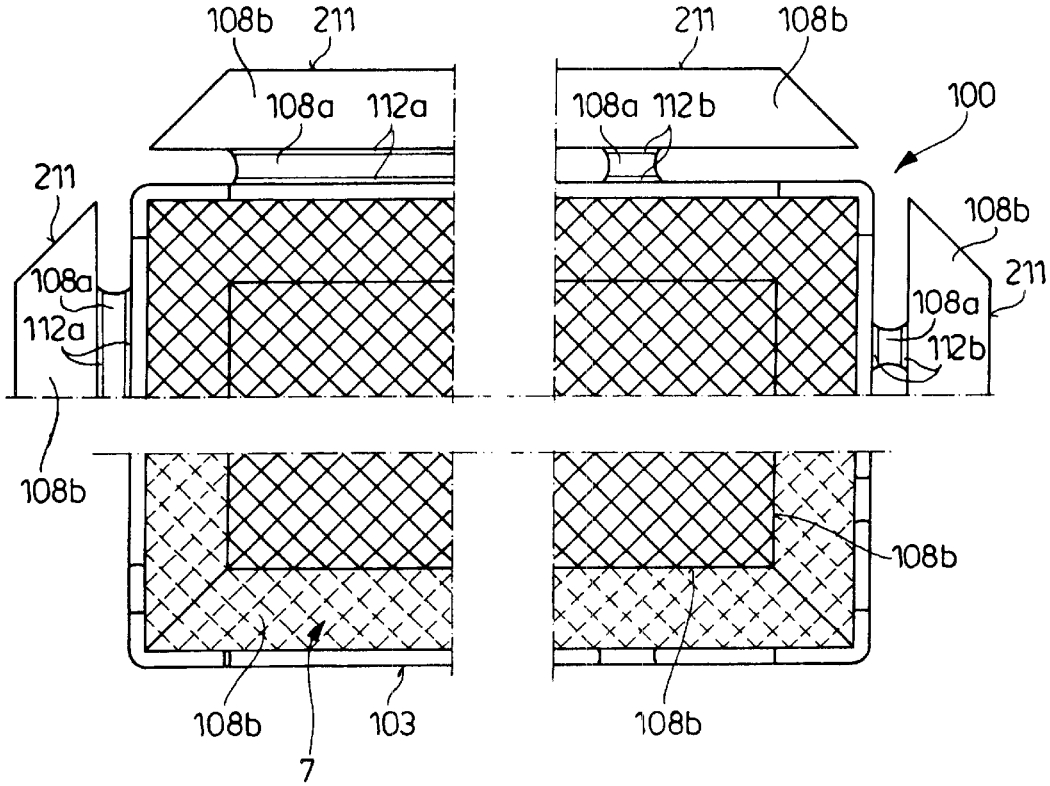
Fig. 8B
Fig. 9
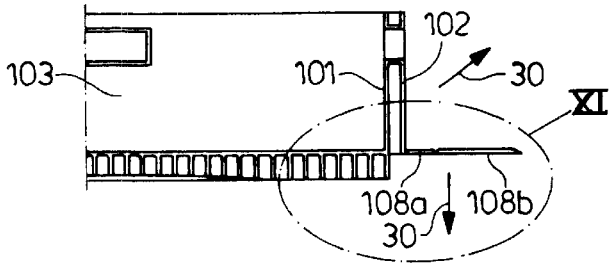
Fig. 10
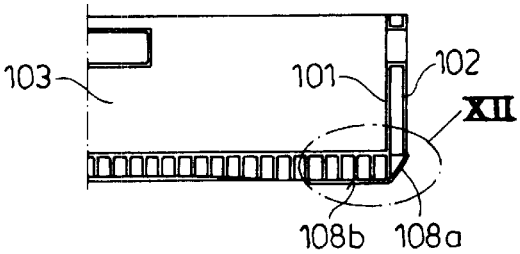

BOX-SHAPED CONTAINER OF SYNTHETIC RESIN MATERIAL

FIELD OF THE INVENTION

My present invention relates to a container composed of synthetic resin material and, especially, a box-shaped container having a bottom which is formed on its exterior with a riding rim and with stiffening ribs.

BACKGROUND OF TUB INVENTION

Box-like containers, especially for storage and transport of solids and liquids, can be comprised of synthetic resin materials and are available in a variety of configurations and constructions. The box or parts thereof may be fabricated by injection-molding techniques and, for example in German patent document DE 37 09 190 C2, a container is described which is formed on the underside of its bottom with stiffening ribs. The stiffening ribs contribute strength to the bottom, which otherwise may be thin-walled, to prevent bulging or deformation of the body under loads such as the load of the material within the container.

In this latter container, the bottom is formed with a running rim or riding rim by means of which the bottom of the container can be displaced onto and can ride along the roller conveyors or the like. The ribs formed on the bottom may provide openings into which a fork can be inserted, enabling the container to be handled with a fork lift vehicle.

In the past, the load within the container often deformed the bottom so that travel of the container onto a conveyor or other surface was prevented or inhibited. In addition with higher loads, the bottom was frequently deformed.

More specifically, when ribs have been provided on the bottom of a container, the travel of the container on and onto rollers and ball conveyor surfaces has been difficult to achieve. The use of automatic equipment for transferring the containers to support and conveyor surfaces has also been precluded.

OBJECTS OF THE INVENTION

It is, therefore, the principal object of the present invention to provide an improved box-like container which can more easily be transferred from one surface to another and displaced along or onto a conveyor than has been the case heretofore.

Another object of this invention is to provide a container for bulk material which can be loaded to a greater extent than has hitherto been the case and nevertheless will not impede transfer of the container onto or along a conveyor.

Still another object of this invention is to provide a container of the type described at the outset which not only has a bottom with a high degree of stiffness but which also will not catch on surface formations of conveyors or supporting surfaces for the container and thus can easily be slid along such surfaces.

A further object of this invention is to provide a bulk container with a high degree of slideability and bottom stiffness and yet which can be fabricated by injection-molding techniques and thus can be manufactured simply and economically.

SUMMARY OF THE INVENTION

These objects and others which will become apparent hereinafter are attained, in accordance with the invention, in a box-like container having a bottom formed with outwardly extending ribs capable of stiffening the bottom and running substantially toward edges of the bottom and flaps connected by film hinges or like means to the bottom and swingable to cover the ribs at least along a sliding rim of the bottom, thereby providing smooth surfaces for the riding rim which enable the container to be transferred to and from conveyors and conveyor surfaces.

According to the invention, the underside of the bottom has film hinges or like ligatures elastically connecting the flaps to the bottom and enabling them to cover at least some of the ribs in the region of the rim and to form smooth surfaces of the rim upon which the container is supported. The flaps may be injection molded in one piece with the bottom and with the film hinge and thus can be integrated in and in one piece with the container. The flaps can form a peripherally closed frame-like riding rim with a smooth surface by which the container can be transported along ball surfaces or roller conveyors since the conveyor balls or wheels or rollers can no longer catch in the ribs or the spaces between them. The ribs also cannot engage between the balls or between the rollers of the conveyor surfaces and that ensures that the container, on a roller table or ball table can readily change directions and be shifted in practically any direction.

The attachment of the cover strips to the bottom of the container, e.g. to a wall structure forming the body of the container and integral with the bottom, can be via a film hinge or, as will be apparent by two or more film hinges or some other bendable, elastic and flexible member forming the connecting ligature. The ligatures allow the inward (or outward) swinging of the strip to cover the ribs, i.e. to underlie the ribs and form the sliding rim which enables the container to be moved without catching on the ribs.

The film hinges or other ligatures can be injection molded together with the container body and the bottom. The sliding rim is thus formed in one piece with the rest of the container.

Preferably, once the strips are folded inwardly they can be attached to the bottom of the container, preferably to the reinforcing ribs, by welding. To retain the strips in their inwardly folded positions, they may be provided with catches which can engage the ribs of the bottom.

The fact that the strips themselves are part of the container body or bottom and can be manufactured directly with the remainder of the container, e.g. by injection molding, but nevertheless can be fabricated in any orientation, being bent into position only during a final procedure after the molding has been completed, enables the container structure to be removed from the mold with ease.

After the demolding step, the strips need only be swung inwardly or bent inwardly and retained in place by welding or the aforementioned catches. The system of the invention results in a substantially cost-saving fabrication, because additional expense for the sliding rim elements can be avoided. The securing of the strip elements to the stiffening ribs, especially by welding, can ensure the formation of hygienically sealed structures with a smooth underside and which can easily be cleaned. The bottom can withstand substantial loads since the rib structure can utilize any number of dimensions of ribs and a greatly increased number of longitudinal and/or transverse and/or diagonal ribs in any pattern, independently of the sliding rim structure. A honeycomb or diamond configuration can be provided. The sliding rim itself is an extremely strong sandwich-like structure because it consists of inner and outer flanges with a rib structure between them and which is exceptionally resistant to torsion as well as to compressive loading. By variation in the degree to which the strips underlie the rib structure of the bottom, the strength of the bottom can be varied in creation of such a sandwich structure. In fact, in the extreme case, the ribs from opposite sides of the container can practically meet so that the rib structure is fully covered at the underside by the strips.

When the container body is a double-wall structure, the strips themselves may be formed in two parts with one part being connected by a respective film hinge or other ligature to an outer wall element of the double-wall structure while the first part is connected to the second part, which actually underlies the rib structure, by another film hinge or ligature. The film hinges may extend continuously the full lengths of the strips or strip parts or may be provided in separate or spaced apart segments along the length of the strip or part thereof.

The strips can easily be formed in horizontal positions parallel to the bottom in the mold and, upon demolding can then be bent at the two ligatures so that the second part of the strip underlies the rib structure of the bottom. The first part thus serves to bridge the spacing between the outer wall of the container body and the rib structure on the bottom while the second part serves to underlie the rib structure.

A further feature of the invention, also applicable to a double-wall container body, has the outer wall connected by one ligature or film hinge to the strip and the strip formed with an angle section at its side connected to the film hinge or ligature so as to allow the orientation of the strip connected to the angle section to cover the ribs while the angle section bridges the gap between the outer wall and the rib structure. In this case, between the outer wall and the rib structure, a recess is provided in which the angle structure can be received.

The angle structure can be formed in one piece with the rib-covering part of the strip. In the injection molding of the container, the strip itself can have a vertical orientation so that the closing force of the molding die can be reduced.

The strip can be provided at its free edges remote from the hinge axis with a detent or locking member which can be injection molded on the strip. This member can be a pin or lug with a nose-like end engageable in a recess or behind a shoulder of a respective stiffening rib. In that case, the strip need only be swung upwardly about the axis of the injection-molded film hinge to be clipped to the rib structure.

According to a further feature of the invention the film hinge is provided on the side of the strip turned toward the outer wall of the container. In that case, the strips are swung inwardly over the ribs in the rim region and can be locked to one or more of the stiffening ribs by the detent means. Between this film hinge and the outer wall of the container, a bridge piece can be provided on the container wall or on the film hinge. Alternatively, the film hinge can be provided along the edge of the strip which is turned away from the outer wall of the container and the film hinge can thus be when one of the stiffening ribs and the strip can be swung outwardly to cover the ribs in the rim region. In that case, the detent means can lock the strips in place proximal to an outer edge of the container bottom.

According to still another feature, the entire rib structure on the underside of the bottom can be covered by a cover plate formed in one or more pieces and which can be retained against the rib structure by welding or by detent means as previously described. The cover can be connected to the bottom by a film hinge or other longitudinal structure.

The assembly formed by the bottom wall, the rib structure and the cover plate constitutes a sandwich structure which has particularly high strength. Since a smooth surface can be formed over the entire bottom, the container can travel more readily over surfaces. The bending resistance of the bottom is enhanced. In this case as well as in the case in which the strips form the rim, the film hinge or ligature can be injection molded together with the bottom and the plate along a transverse or longitudinal wall of the container.

When a cover plate is provided, it can be held in its middle region as well as along edges opposite the ligature to the ribs on the underside of the bottom. The detent means which is used for that purpose can be snap hooks, clops, barbed hooks or the like which can be formed on the rib structure or the container bottom or on the cover plate or strip and can be engageable in a hole or opening in the opposing member. More particularly, the box shaped container of the invention can comprise:

a bottom formed of a synthetic resin material and having downwardly projecting stiffening ribs, and strips connected to the bottom by bendable ligatures and adapted to cover the ribs at least along part of a perimeter of the bottom, thereby forming a riding rim along the bottom.

Alternatively the box shaped container can comprise:

a bottom formed of a synthetic resin material, and a double-wall structure on the bottom, the bottom having downwardly projecting stiffening ribs, and a cover plate formed in at least one piece and connected to the bottom by at least one bendable ligature and adapted to cover the ribs, thereby forming a riding surface along the bottom.

BRIEF DESCRIPTION OF THE DRAWING

The above and other objects, features, and advantages will become more readily apparent from the following description, reference being made to the accompanying drawing in which:

FIG. 8A is a bottom view somewhat diagrammatic of a portion of a container prior to the inward swinging of the strip elements;

FIG. 8B is a view similar to FIG. 8A but showing the elements swung inwardly;

FIG. 9 is a detail of the container of FIGS. 8A or 8B in section through a bottom portion thereof with the strip element outwardly swung as removed from the mold;

FIG. 10 is a section similar to FIG. 9 but with the strip element swung inwardly;

SPECIFIC DESCRIPTION

Figure 1:
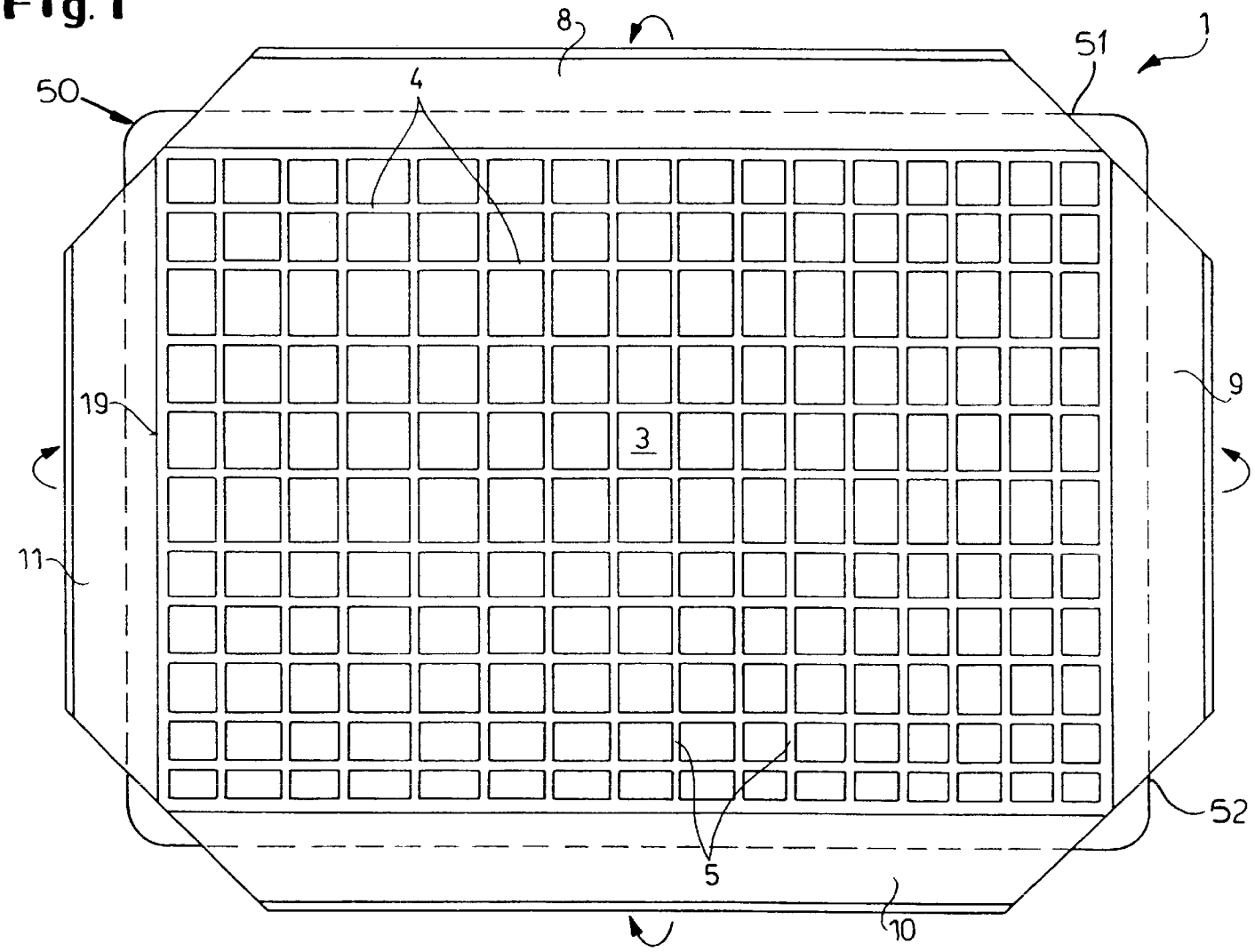
FIG. 1 is a bottom view of a container according to the invention prior to the inward swinging and anchoring of the strips which will ultimately form the sliding rim thereof.

In FIG. 1, I have shown a storage and transport container 1 for bulk materials, e.g. liquids or flowable solids or other types of solid materials which is of substantially rectangular configuration, with a container body 50 extending into the plane of the paper and away from the viewer and a container bottom 3. The container 1 can have two vertical longitudinal walls 51 and 2 vertical transverse walls 52 which are perpendicular to the bottom 3 and can be injection molded therewith. The body 50 and the walls 51 and 52 are conventional and thus have not been shown in detail.

Figure 2:
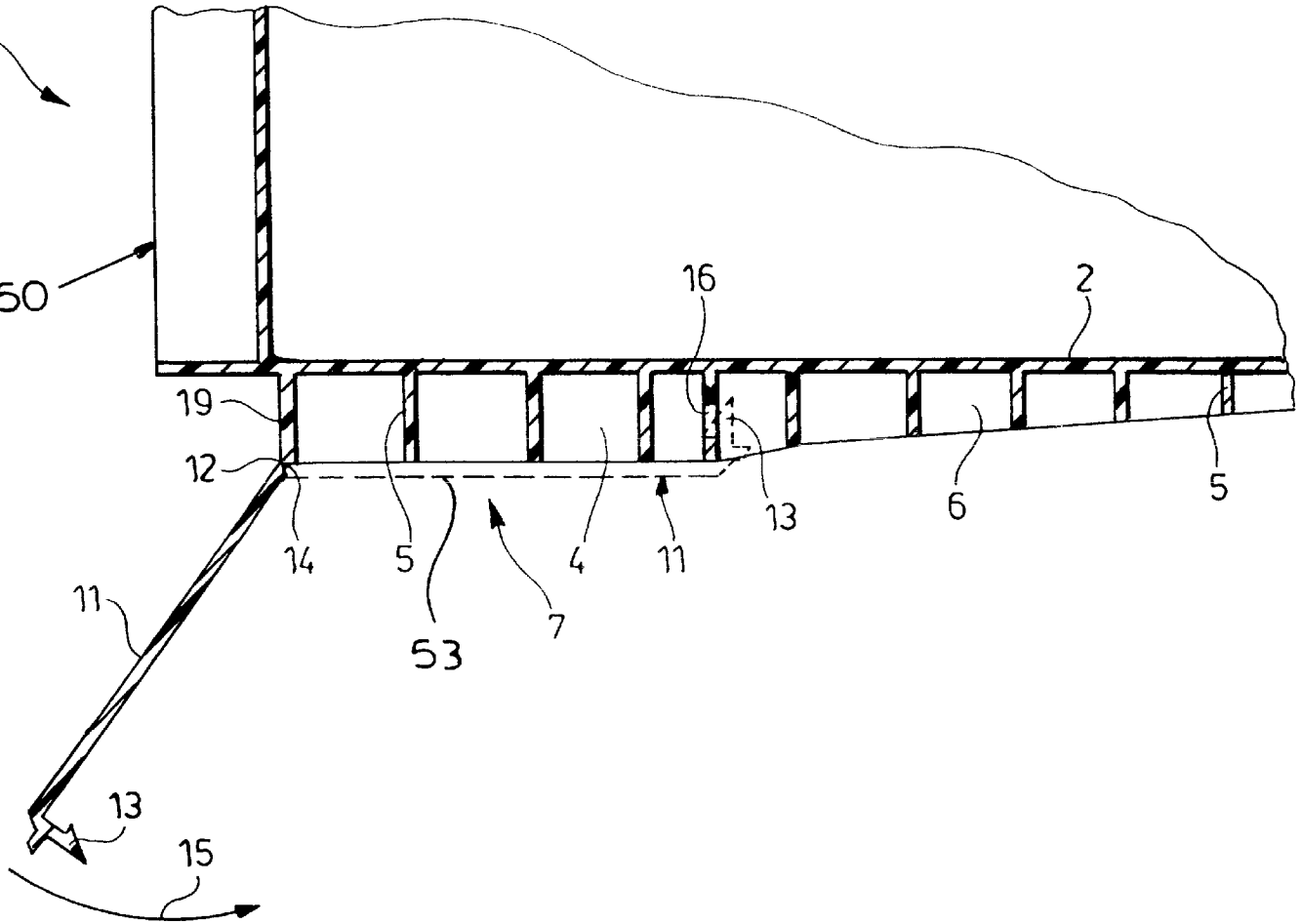
FIG. 2 is a cross sectional view through a portion of the bottom and outer wall region of a container according to the invention showing a flap or strip about to be swung upwardly to cover the rib structure along the sliding rim or crown.

The bottom 3, however, has a flat upper surface 2 (see FIG. 2) and an underside which is formed with longitudinal ribs 4 and transverse ribs 5, the ribs being molded unitarily with the remainder of the container and serving to reinforce the bottom. In the illustrated embodiment the ribs interconnect with one another to form rectangular spaces between them. It will be understood that the ribs can also be inclined to the longitudinal and transverse edges of the bottom and can define a triangular, diamond or honeycomb pattern as may be desired. The bottom can have a central region 6 which can be offset upwardly from a riding rim 7 (see FIGS. 2–4). The rim 7 can extend all around the perimeter of the bottom of the container and can form a smooth sliding surface along the surface 53 shown in FIG. 2 for example.

Figure 3:
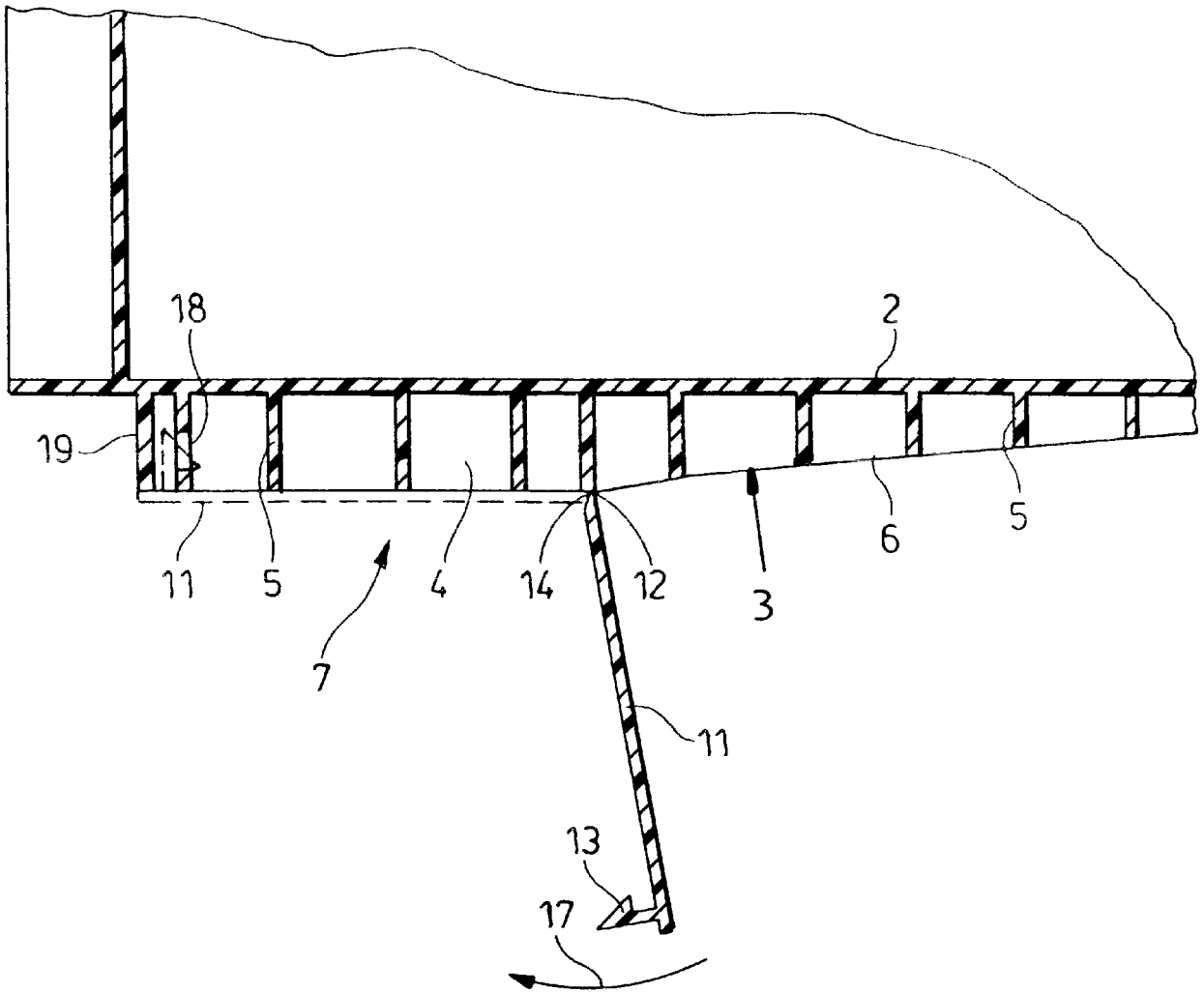
FIG. 3 is a view similar to FIG. 2 illustrating another embodiment of the invention.

The longitudinal and transverse ribs 4 and 5 of the riding rim 7 facilitate travel of the container 1 along conveyors and other surfaces. The riding rim 7 is itself formed, in the embodiment of FIGS. 1 and 2, by strips or flaps 8–11 connected by continuous film hinges 12 to the outer ribs 19 of the rib structure 4, 5 and molded unitarily therewith. The film hinges 12, which are injection molded with the remainder of the container, define pivot axes 14 at the free ends of the strip 8–11 enabling the strips to be swung inwardly (arrow 15 in FIG. 2) to cover the rib structure in the rim region (see the broken line in FIG. 2). A barbed pin 13 at the free end of each strip 11 can engage in an opening 16 in a respective one of the stiffening ribs 5 to hold each flap or strip in place. The result is a continuous rim along the bottom formed by the surfaces 53 of the strips 8–11 on which the container can ride. In FIG. 3, I have shown an alternative arrangement in which the film hinges 12 are formed along the strips 11 at their edges turned away from the outer edge of the bottom 3 while the pins or detentes 13 are formed at outwardly swung free edges of these strips to engage in openings 18 in a rib 5 close to the outer edge 19 of the bottom. The swinging action of the strips 11 etc. is in the direction of the arrow 17.

Figure 4:
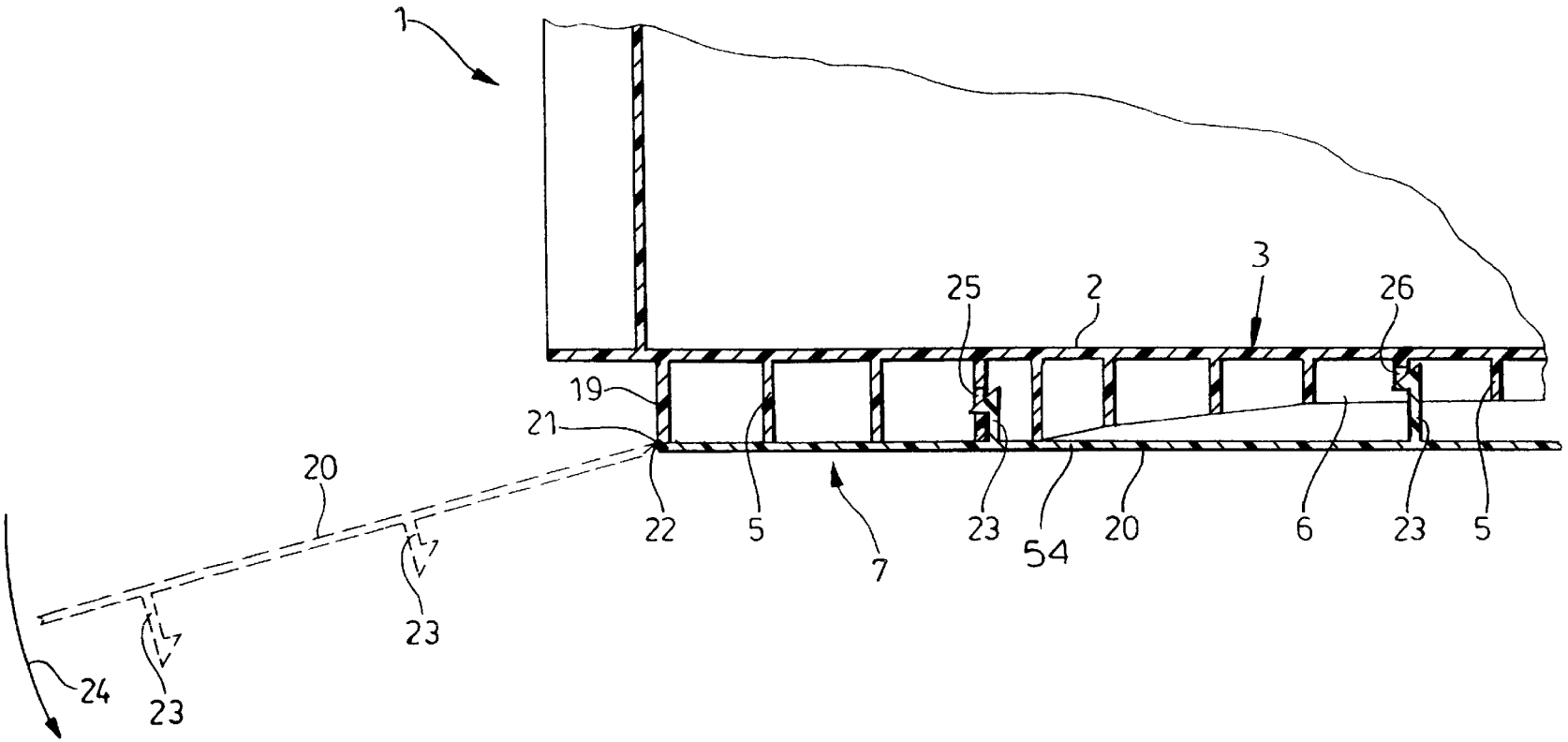
FIG. 4 shows still another embodiment in which the rib structure is covered by a cover plate.

As FIG. 4 shows, the central portion 6 of the rib structure 4, 5 on the underside of the bottom 3 can also be completely covered by a plate 20 so that the latter closes the riding rim 7 as well as the central portion 6 of the bottom from below to provide a smooth surface 54 on which the container can ride.

The cover plate 20 is here connected by means of a film hinge to an outer edge 19 along a transverse or longitudinal wall of the container 1.

On a portion of the cover plate 20 spaced from the film hinge 21, which forms the pivot axis 22, detent means 23, for example barbed pins, can be provided to lock the cover plate 20 over the rib structure. The open position of the cover plate 20 has been shown in broken lines in FIG. 4, the direction of pivoting action is represented by the arrow 24 and the openings in which the barbed pins 23 engage in the ribs 5 of the riding rim 7 or the central portion 6 as represented at 25 and 26 in FIG. 4.

Figure 5:
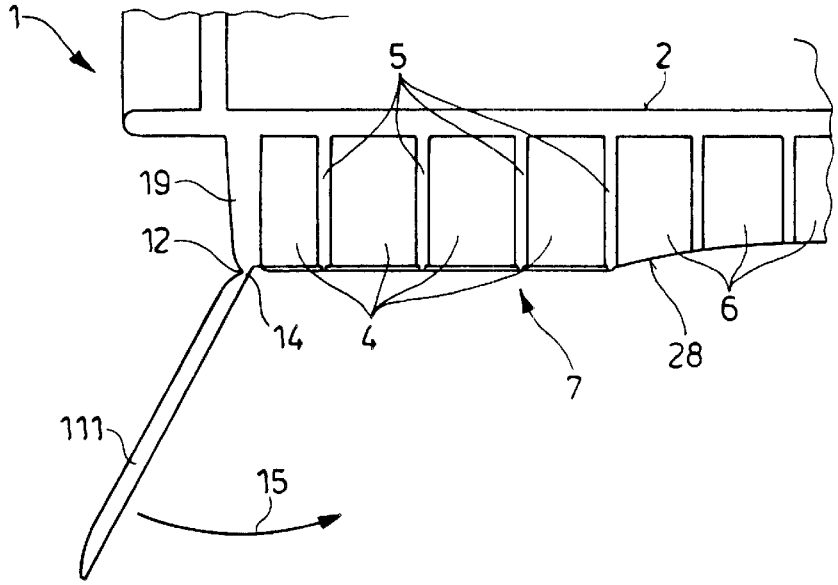
FIG. 5 is a cross sectional view of a portion of a container showing another configuration of the film hinge and strip.
Figure 6:
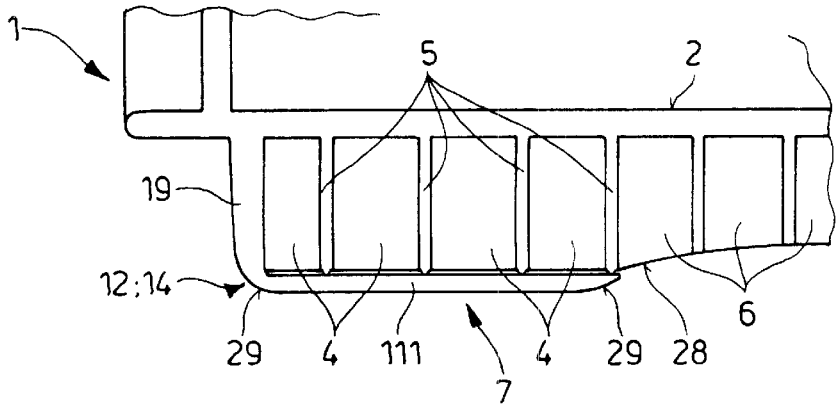
FIG. 6 is a view similar to FIG. 5 with the strip in its upwardly folded position.
Figure 7:
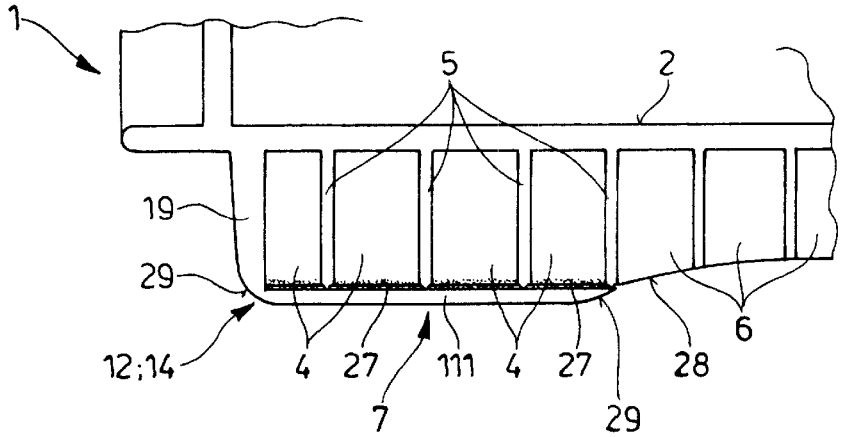
FIG. 7 is a view similar to FIG. 6 after welding of the strip or flap is in place.
Figure 11:
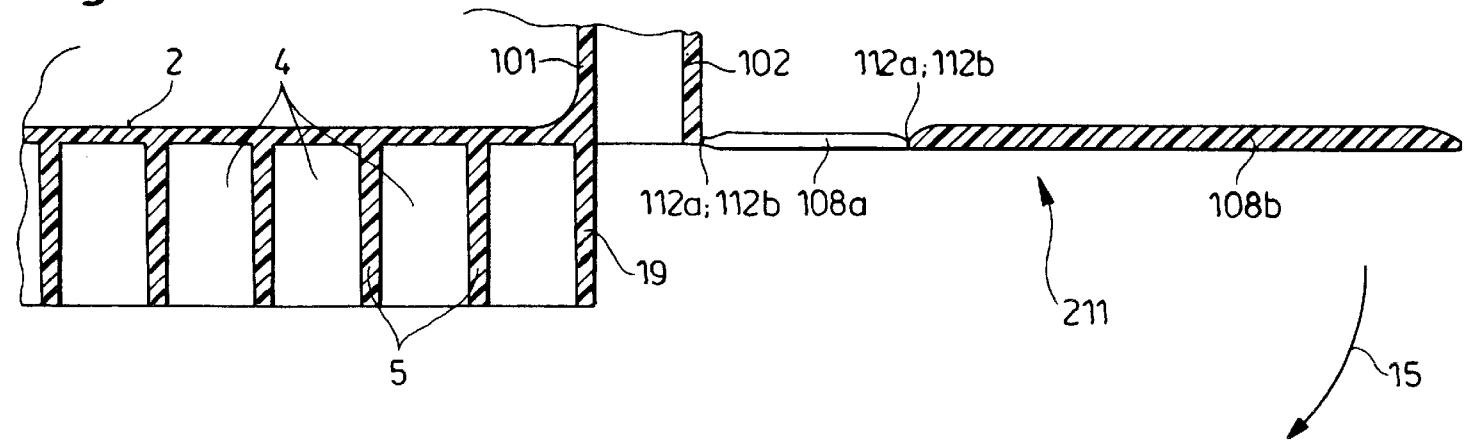
FIG. 11 is a view of the detail XI of FIG. 9;.

FIGS. 5–7 show that the film hinge 12 can connect the outermost rib 19 or the outermost edge of the rib structure of the bottom to the strip or flap 111 so that the latter can pivot about the axis 14 of the resulting hinge in the direction of the arrow 15. The closed position is shown in FIG. 6 and in this position the rib structure 4, 5 is spanned by the strip 111 which can ultimately be fused to the ribs at the welds represented at 27.

In the region of the riding rim 7, the bottom has a sandwich structure as has been mentioned previously to stiffen the bottom to even a greater extent than is provided by the ribs 4, 5 themselves and toward the central region 6, the ribs are set back from the strip 111 on which the container rests by the recess region 28. The sandwich structure acts as a beam or girder which increases the load carrying capacity, stiffens the bottom against torsion and effectively closes the cells formed between the ribs.

Along their opposite edges, the strips 11 are rounded, radiuses or bevelled at 29 to allow the container to slide in a trouble free manner along roller conveyors, ball conveyors and tables and onto conveyor belts.

The embodiment illustrated in FIGS. 8A, 8B and 9–12, is a double wall container having an inner wall 101 and an outer wall 102 from the container body 103 (compare FIGS. 9–12). The flaps or strips 211 are here of a bipartite construction and have a first or inner part 108*a* and a second or latter part 108*b*. The first part 108*a* is connected by a film hinge 112*a* or 112*b* to the outer wall 102 of the container and to the other part 108*b*, respectively. Each of these inner parts may be continuous over the entire side of the bottom (see the left side of FIG. 8A) or interrupted in the form of a web of limited length of which several can be provided (see the right side of FIG. 8A. The film hinges 112*a* and 112*b* can be similarly continuous or in the form of spaced apart webs. In either case the hinges and the inner parts 108*a* are formed by injection molding and can lie at the separation plane of the injection mold (compare FIGS. 9 and 11) so that demolding can be ensured in the direction of the arrow 30 in FIG. 9, the sliders for the side walls being movable laterally outwardly.

Figure 12:
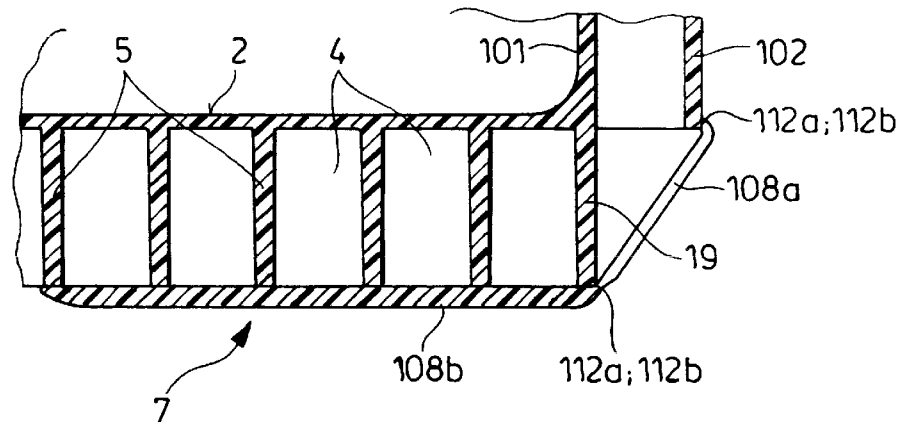
FIG. 12 is a view of the detail of FIG. 10.

To fabricate the riding rim 7 (see FIG. 8B) the strips 211 are swung inwardly (arrows 15) in which the gap between the outer most rib 19 and the outer wall 102 is bridges by the inner parts 108*a* (compare FIGS. 10–12) before the outer part 108*b* consider to overlie the ribs 4 and 5. The stirps can then be welded in place as shown in FIGS. 8B and 12.

Figure 13:
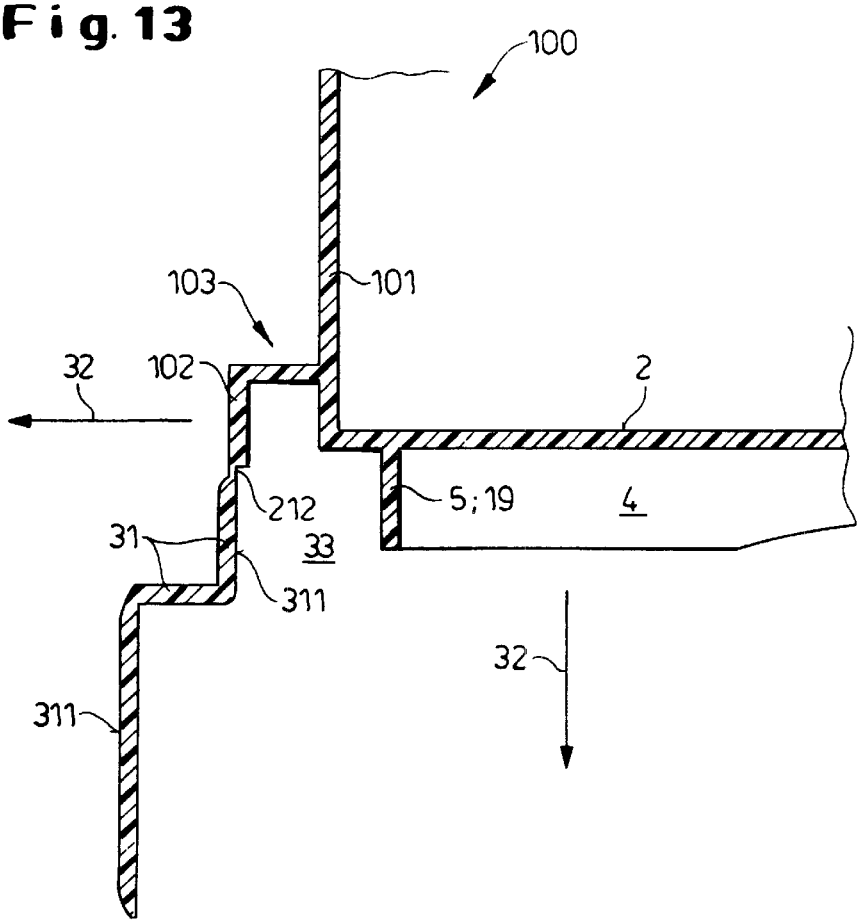
FIG. 13 is a cross sectional view of a double wall container similar to the container of FIGS. 8A and 8B in which the flap is removed from the mold in a vertical orientation.
Figure 14:
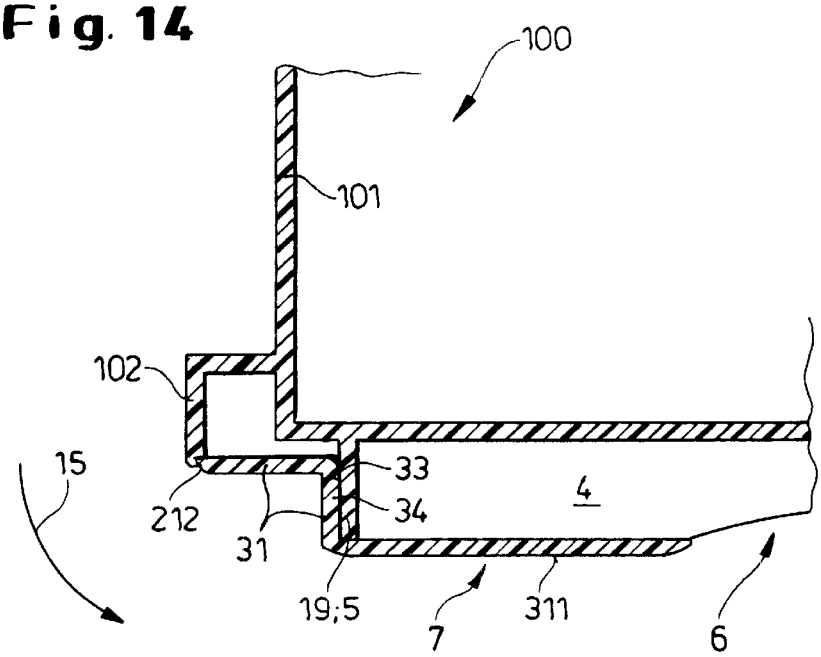
FIG. 14 is a detail cross section through a bottom portion of the container of FIG. 13 showing the inwardly swung flap or strip.

FIGS. 13 and 14 show another type of double wall structure for the container 100. In that case, the strip 311 can have an angle portion 31 which bridges between the outer wall 102 and the outer most rib 19 and is received in a recess 33 surrounding the bottom. The film hinge 212 is provided between the lower edge of the outer wall 102 and the angle segment 31. Once the container is demolded (see the arrows 32), the strip 311 can be folded upwardly (arrow 15 in FIG. 14) until the leg 34 of the angle 31 comes to rest against the outer rib 19 and in the recess. This affords a greater strengthening of this portion of the container and eliminates any need for cutting off or removing the angle section 31.

I claim:

1. A box-shaped container comprising a bottom formed of a synthetic resin material and having downwardly projecting stiffening ribs, and strips connected to said bottom by bendable ligatures and adapted to cover said ribs at least along part of a perimeter of the bottom, thereby forming a riding rim along said bottom.

2. The container defined in claim 1 wherein said ligatures are film hinges.

3. The container defined in claim 2 wherein said film is hinges are formed as individual webs.

4. The container defined in claim 2 having a double-wall container body formed on said bottom, said body having an outer wall connected to at least one of said strips, said at least one of said strips having a first part connected to said outer wall by a first film hinge and a second part underlying said ribs to form said rim and connected to said first part by a second film hinge.

5. The container defined in claim 2 having a container body formed on said bottom and including a wall, at least one of said strips having an angle section connected to said film hinge and connected by said film hinge to said wall.

6. The container defined in claim 5 wherein said wall is an outer wall of a double-wall structure forming said body and said container is formed with an outwardly open recess alongside said bottom and receiving said angle section.

7. The container defined in claim 5 wherein said wall is an outer wall of a double-wall structure forming said body and said film hinges connect said strips with outer walls of said body.

8. The container defined in claim 5 wherein said wall is an outer wall of a double-wall structure forming said body and said film hinges connect said strips with said ribs along edges of said strips remote from said outer walls of said body.

9. The container defined in claim 2 wherein said strips are secured to said ribs by welds.

10. The container defined in claim 2, further comprising detentes on free edges of said strips engageable with said ribs to hold said strips over said ribs in forming said riding rim.

11. A box-shaped container comprising a bottom formed of a synthetic resin material, and a double-wall structure on said bottom, said bottom having downwardly projecting stiffening ribs, and a cover plate formed in at least one piece and connected to said bottom by at least one bendable ligature and adapted to cover said ribs, thereby forming a riding surface along said bottom.

12. The container defined in claim 11 wherein said cover plate is one piece and covers all of the ribs of said bottom.

13. The container defined in claim 12 wherein said ligature is a film hinge.

14. The container defined in claim 12 wherein said plate is provided with detentes for securing said plate to said ribs.

15. The container defined in claim 12 wherein said plate is connected by welds to said ribs.

16. The container defined in claim 12 wherein said film hinge is a single web extending over the length of an edge of said plate.

17. The container defined in claim 12 wherein said film hinge is formed from a plurality of webs extending over said length of said edge of said plate.

* * * * *